US006148451A

United States Patent [19]

DeBraal et al.

[11] Patent Number: 6,148,451

[45] Date of Patent: Nov. 21, 2000

[54] SHOWER DOOR ATTACHMENT ASSEMBLY

[75] Inventors: Timothy S. DeBraal; David R. Funk, both of Sheboygan, Wis.

[73] Assignee: Kohler Co., Kohler, Wis.

[21] Appl. No.: 09/291,392

[22] Filed: Apr. 14, 1999

[51] Int. Cl.[7] ..... A47K 3/02

[52] U.S. Cl. ..... 4/607; 4/557; 49/410

[58] Field of Search ..... 4/557, 607; 49/410, 49/411

[56] References Cited

U.S. PATENT DOCUMENTS 1,067,678 7/1913 Prim .
3,683,451 8/1972 Tanner ..... 49/410
3,701,179 10/1972 Cox .
4,228,560 10/1980 Baus ..... 4/607 X
4,769,949 9/1988 Glendowne .
4,785,485 11/1988 Etesam .
5,480,199 1/1996 Husting ..... 4/607 X
5,848,446 12/1998 DeBraal .

*Primary Examiner*—Charles E. Phillips
*Attorney, Agent, or Firm*—Quarles & Brady LLP

[57] ABSTRACT

A shower door assembly is disclosed that has a connector vertically slidably attached to a lower door. The connector corrects for out of plumb conditions when linked to a curb rail, and inhibits door swing. The connector may be assembled after the curb is mounted to a surface due to a transverse lateral connection involving multi-rotatonal positions.

12 Claims, 3 Drawing Sheets

SHOWER DOOR ATTACHMENT ASSEMBLY

BACKGROUND OF THE INVENTION

This invention relates to shower doors, and more particularly to shower door attachment assemblies.

Shower doors help enclose a shower or tub area to prevent water from collecting on the floor outside the shower area, while also allowing entry to the shower area. Conventional shower door assemblies have one or more doors, each having a frame in which a panel of plastic or glass is mounted.

The shower frame can be slidably attached to a fixed track mounted at the top (and usually also at the bottom) of the door opening. At the top of each shower door glides or rollers are typically mounted on hangers, and each glide or roller is movably supported on a fixed track mounted above the shower door opening. The shower door slides along the track to allow access to the shower area. Multiple doors in an assembly are typically offset from each other to allow doors on separate tracks to pass each other. See generally U.S. Pat. No. 4,769,949.

If the surface of a tub has a slight downward bow, or if the curb, track or frame is otherwise out of plumb, a shower door may bind. Therefore, it is desirable to provide a shower door attachment assembly that can compensate for this.

Prior art systems, such as disclosed in U.S. Pat. No. 4,769,949, do allow for bowed tubs or out of plumb doors in the vertical direction, but the correction is sometimes unduly complex, expensive, or subject to breakage. Additionally, prior art systems which allow movement in the vertical direction may have a tendency to allow the shower doors to swing in the transverse direction (in and out of the tub) which may cause the door to derail.

A particular system, disclosed in U.S. Pat. No. 5,848,446 has a vertically slidable connector with a cylindrical bottom retained in a track of a curb. The track restrains the connector in the transverse direction to prevent the shower door from swinging. This particular configuration has a connector that must be slipped into an end of the c-track prior to mounting the curb to the tub, which can be inconvenient. Also, the structures required to achieve this may disrupt the aesthetic design.

Therefore, a need exists for a shower door attachment having a vertically slidable connector, that also prevents door inward and outward swinging, and also can be easily assembled after the curb is mounted to the tub.

BRIEF SUMMARY OF THE INVENTION

In one aspect, the invention provides a shower door assembly having a door with a bottom portion, a frame on the bottom portion, and a connector having one end linked to the frame and a connector portion on the other end. There is also a curb rail longitudinally slidably connected to the connector portion, the connector portion being laterally connected to the curb rail.

The rail and connector are constructed and arranged such that part of the connector can pass into the rail when the two are in a first rotational position relative to each other, more of the connector may pass into the rail when the two are in a second rotational position relative to each other, and the rail and connector are locked together in a lateral transverse direction at a rotational position between the first and second rotational positions.

In preferred forms the connector portion can be generally cylindrical, albeit longitudinally notched. Also the curb rail can have a c-shaped cross-section track and the connector portion can be receivable in the track. If desired, both doors can be connected to such rails in this manner.

To correct for out-of-plumb conditions, the connector can be slidably vertically linked to the frame. Preferably, the frame has a cavity, and the connector has an end disposed in the cavity. In one form the cavity has a top with a slot, and the connector has a tip disposed in said slot. Also, a connector end can have a longitudinal rib formed thereon, the rib being disposed in the cavity. Inwardly extending flanges retain the connector end in the cavity, and the cavity is formed by joining front and back frame members. The frame back is hingedly connected to the frame front.

In another form the shower door assembly has a door with a bottom portion and a connector having one end vertically slidably linked to the frame and a connector portion on the other end. The connector is coextensive with the bottom door portion and there is a curb rail longitudinally slidably connected to the connector portion. The connector portion and the curb rail are constructed and arranged to allow a transverse lateral connection of the connector portion to the curb rail.

The present invention provides a shower door attachment assembly that can be attached to the shower door in a way that permits vertical adjustment and inhibits door swinging.

The objects of the invention therefore include:

a. providing a shower door attachment assembly that corrects for out of plumb variations;

b. providing an assembly of the above type that can be assembled after the curb is mounted to a tub; and c. providing a shower attachment assembly that is not subject to easy derailment.

These and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
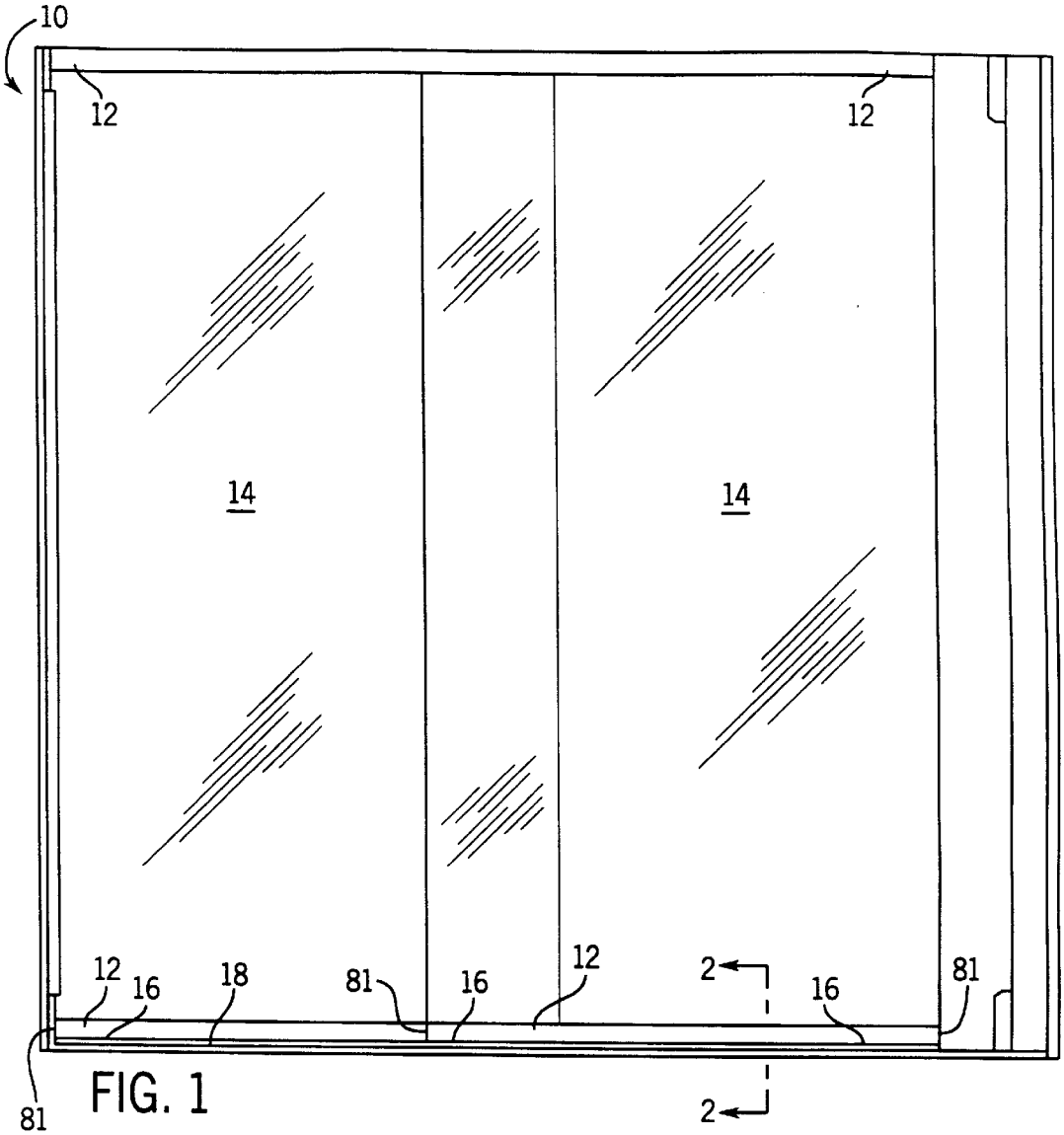
FIG. 1 is a rear elevational view of a bypass shower door assembly which employs the present invention.

Referring to FIG. 1, a bypass type shower door assembly (generally 10) is shown. It has frames 12 mounted to the top and bottom of doors 14. A linking connector 16 is vertically slidably attached to each frame 12. Connectors 16 are also horizontally slidably attached to top and bottom curbs 18 in the direction of door travel, allowing the door 14 to be slid open or closed for access to a shower enclosure. The top frame, curb, and connectors are substantially identical to the bottom frame, curb, and connectors. Therefore, only the bottom frame, curb, and connectors will be described below with the understanding, that the description also applies to the top frame, curb, and connectors.

Figure 2:
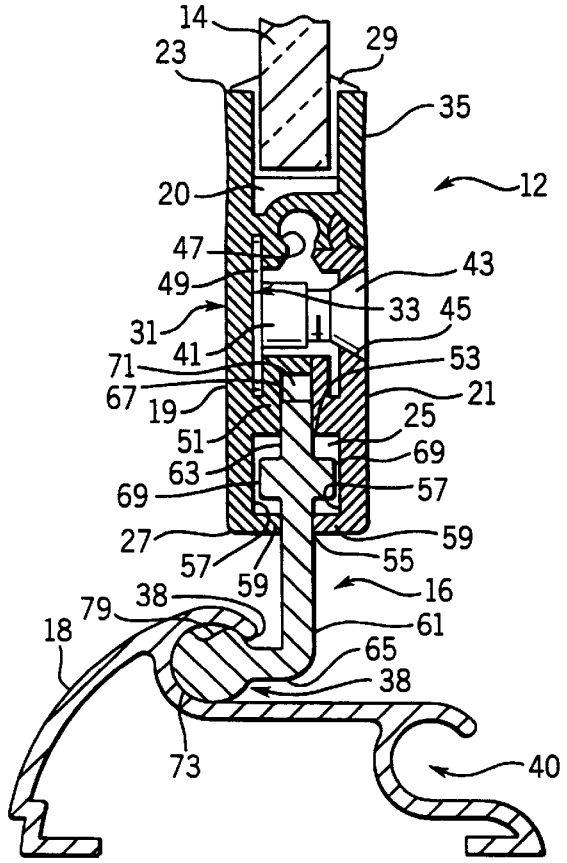
FIG. 2 is a view in cross section, taken on line 2—2 of FIG. 1.
Figure 3:
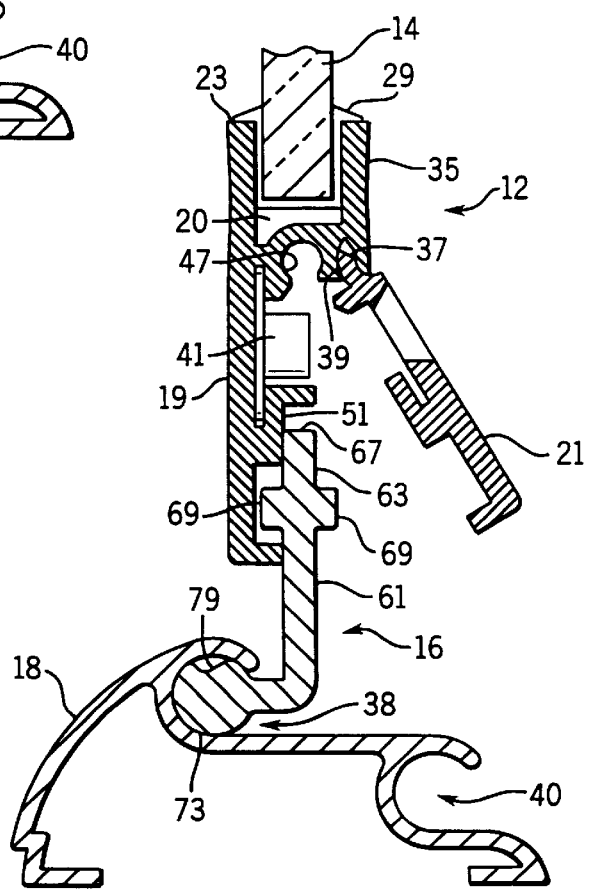
FIG. 3 is a view similar to FIG. 2 with a frame back member partially disassembled.
Figure 5:
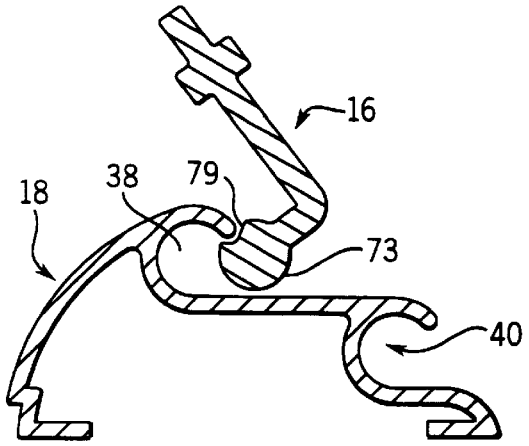
FIGS. 5–8 are schematic views showing steps in the assembly of the FIG. 1 components.
Figure 6:
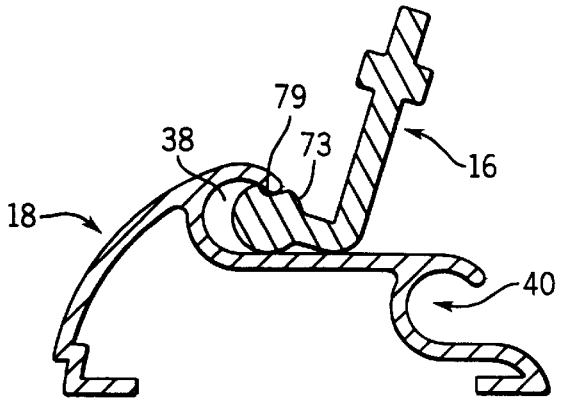
Figure 7:
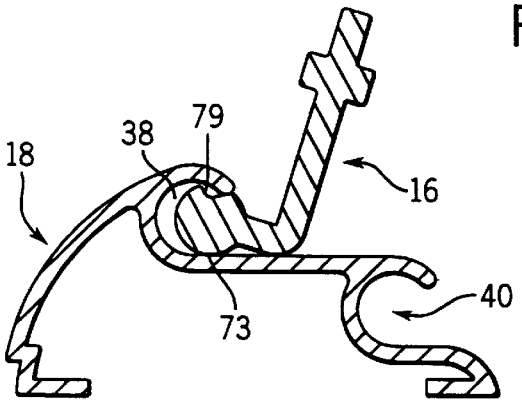
Figure 8:
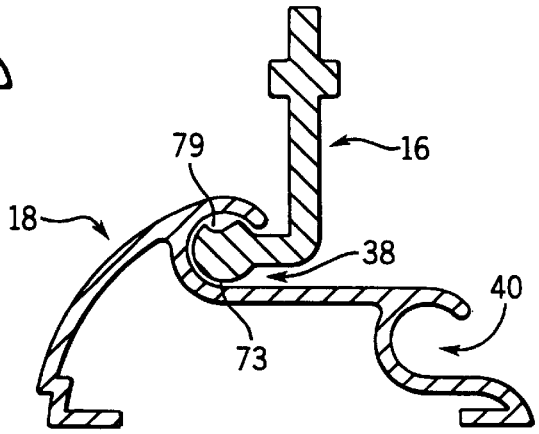

Referring to FIGS. 2 and 3, the frame 12 has a front member 19, and a back member 21 hingedly connected to the front member 19. Preferably, the frame members 19, 21 are formed from an extruded metal, such as aluminum. Shower door glass panel 14 is wedged into a channel 20 formed in a mounting end 23 of the front member 19, and a connector 16 has one end vertically slidably disposed in a cavity 25 formed by the frame members 19, 21 at the frame connector end 27. The frame 12 is fastened to the door panel 14 using conventional means such as adhesives or screws (not shown). End caps 81 slipped over the frame ends keep the connectors 16 from slipping out of the frame ends. (See FIG. 1)

An edge guard 29 may be wrapped around the door panel edge to protect it from damage. If an edge guard 29 is used, it is conventionally mounted to the door panel 14 and interposed between the frame 12 and the panel 14. The frame 12 is then conventionally mounted to the edge guard 29.

The frame front member 19 has a substantially flat vertical front face 31, and a rear face 33. A channel flange 35 extends rearward from the rear face 33 and forms the channel 20 for receiving the door panel 14 at the mounting end 23. An arcuate slot 37 formed in the channel flange 35 receives an arcuate tab 39 formed on the frame back member 21 to hingedly connect the frame front and back members 19, 21.

A blind T-nut 41 having a nut flange 49 is mounted to the front member rear face 33 to secure the back member 21 to the front member 19. A screw 43 inserted through a countersunk aperture 45 formed in the frame back member 21 threadably engages the blind T-nut 41 to clamp the frame members 19, 21 together. Preferably, a first nut retention lip 47 extending from the channel flange 35 proximal the rear face 33 engages one side of the nut flange 49, and a second nut retention lip 51 extending from the rear face 33 engages an opposing side of the nut flange 49. The lips 49, 51 extend longitudinally along the length of the front member 19 and securely retain the nut 41 against the rear face 33.

The frame back member 21 mates with the frame front member 19 to form an elongated open cavity 25 at the frame connector end 27 for receiving one end of the connector 16. The cavity 25 has a slotted top 53 and open bottom 55 connected by opposing sides 57. Inwardly directed flanges 59 formed on the front and back members 19, 21 at the cavity bottom 55 narrow the cavity bottom 55 opening to prevent the connector 16 from slipping out of the cavity 25.

Figure 4:
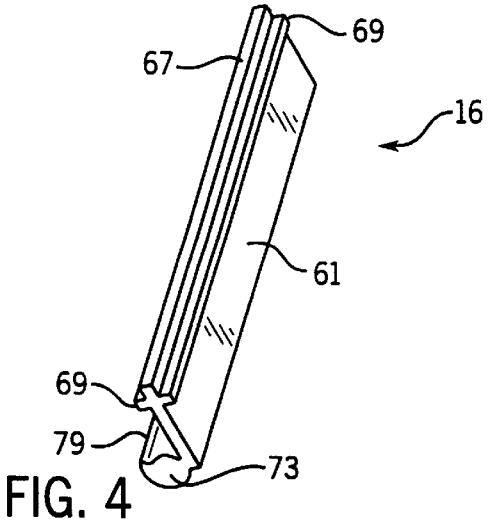
FIG. 4 is a perspective view of a connector employed in the assembly of FIG. 1.

Looking particularly at FIG. 4, connector 16 is vertically slidably connected to the frame 12 at one end, and horizontally slidably connected to the curb 18 at the other end. The connector 16 is coextensive with the bottom portion of the panel 14. It has a body 61 defining a vertical plane, a frame connecting end 63 disposed in the frame cavity 25, and a curb connecting end 65 engaging the curb 18. The frame connecting end 63 has a tip 67, and a pair of longitudinal horizontal ribs 69 formed on opposing body sides. The tip 67 is disposed in the slot 71 formed in the cavity top 53, and the opposing ribs 69 are spaced a distance away from the tip 67 and interposed between the cavity sides 57. Preferably, the cavity 25 and cavity slot 71 are sized to allow vertical movement of the connector tip 67 and ribs 69, while restricting transverse movement (that is movement perpendicular to the plane defined by the door).

The connector connecting end portion 65 has a cylindrical lobe 73 transversely offset from the connector vertical plane, and is horizontally slidably retained in the curb 18. The cylindrical lobe 73 has a top half with a longitudinal notch 79 formed therein to allow lateral insertion of the lobe 73 into a c-track 38 of the installed curb 18 with the curb ends blocked.

As shown in FIGS. 5–8, the notch 79 allows the lobe 73 to pass the upper edge of the c-track 38 when the connector 16 is transversely pivoted. Preferably, the lobe cross section is sized to fill the c-track with sufficient clearance to allow horizontal sliding without binding or transverse movement which causes chattering.

As best seen in FIGS. 2 and 3, the shower door 14 can move in the horizontal direction along the curb rail 18. The door 14 is retained by the cylindrical lobes 73 of each connector 16 being slidably retained in a c-track 38 in each curb rail 18 when the connector plane is substantially vertical.

The connector lobe 73 freely slides in the direction of door travel in the track 38 along the length of the curb 18. As a result any debris or fluid that happens to enter a track 38 is ejected as the lobe 73 passes through, causing the track 38 to be self cleaning.

As shown in FIGS. 2 and 3, each curb rail 18 contains two tracks 38, 40. The first track 38 is disposed above the second track 40 and is offset relative to the second track 40. The exterior of the curb 18 can be a convex curvilinear shape to prevent the pooling of water on the exterior surface. Curbs 18 are preferably a continuously extruded metal such as aluminum.

The connector 16 and the curb rail 18 are assembled by mounting the curb at the shower opening, and then pivoting the connector 16 to insert the lobe 73 laterally into the curb c-track 38. In use, the assembly permits the door to "float" relative to the curb rails 18, thereby correcting for out of plumb conditions. The above is considered to be the preferred embodiment of the invention. However, those skilled in the art will appreciate that various changes and modifications can be made without departing from the scope of the invention as defined by the appended claims.

For example, one could hang a shower door using conventional methods and secure only the door bottom using the present invention. Thus, the claims should be looked to in order to judge the full scope of the invention.

What is claimed is:

1. A shower door assembly comprising;

a door having a bottom portion;

a frame on said bottom portion;

a connector having one end linked to the frame and a connector portion on the other end; and a curb rail longitudinally slidably connected to the connector portion and said connector portion being laterally connected to said curb rail;

wherein the rail and connector are constructed and arranged such that part of the connector can pass into the rail when the two are in a first rotational position relative to each other, more of the connector may pass into the rail when the two are in a second rotational position relative to each other, and the rail and connector are locked together in a lateral transverse direction at a rotational position between the first and second rotational positions.

2. The shower door assembly as defined in claim 1, wherein said connector portion is generally cylindrical, but is longitudinally notched.

3. A shower door as in claim 2, wherein said curb rail has a c-shaped cross-section track and said connector portion is receivable in said track.

4. A shower door assembly of claim 3, wherein the curb has a second c-shaped cross-section track for receiving a connector cylindrical portion of a connector linked to a frame mounted to a second door.

5. The shower door assembly as in claim 1, wherein the connector is slidably vertically linked to said frame.

6. The shower door assembly as in claim 1, wherein said frame has a cavity, and said connector one end is disposed in said cavity.

7. The shower door assembly as in claim 6, wherein said cavity has a top with a slot, and said connector one end has a tip disposed in said slot.

8. The shower door assembly as in claim 6, wherein said connector one end has a longitudinal rib formed thereon, and said rib is disposed in said cavity.

9. A shower door as in claim 6, wherein inwardly extending flanges retain said connector one end in said cavity.

10. A shower door as in claim 6, wherein said cavity is formed by joining front and back frame members.

11. A shower door as in claim 10, wherein said frame back is hingedly connected to said frame front.

12. A shower door assembly comprising:

a door having a bottom frame;

a connector having one end vertically slidably linked to the frame and a connector portion on the other end, said connector being coextensive with said bottom door frame;

a curb rail longitudinally slidably connected to said connector portion, said connector portion and said curb rail being constructed and arranged to allow a transverse lateral connection of said connector portion to said curb rail;

wherein said curb rail has a c-shaped cross-section track and said connector portion has a cylindrical head with a notch therein.

* * * * *